US009950403B2

(12) United States Patent
Kröplin

(10) Patent No.: US 9,950,403 B2
(45) Date of Patent: Apr. 24, 2018

(54) DEVICE FOR GRINDING AND DEBURRING A FLAT WORKPIECE

(71) Applicant: ARKU Maschinenbau GmbH, Baden-Baden (DE)

(72) Inventor: Dirk Kröplin, Karlsruhe (DE)

(73) Assignee: ARKU Maschinenbau GmbH, Baden-Baden (DE)

( * ) Notice: Subject to any disclaimer, the term of this patent is extended or adjusted under 35 U.S.C. 154(b) by 182 days.

(21) Appl. No.: 15/134,471

(22) Filed: Apr. 21, 2016

(65) Prior Publication Data

US 2016/0332275 A1 Nov. 17, 2016

(30) Foreign Application Priority Data

Apr. 24, 2015 (EP) ..... 15165026

(51) Int. Cl.

| | |
|---|---|
| ***B24B 9/00*** | (2006.01) |
| ***B24B 7/12*** | (2006.01) |
| ***B24B 27/033*** | (2006.01) |
| ***B24B 47/12*** | (2006.01) |
| ***B24B 41/00*** | (2006.01) |
| ***B24B 47/10*** | (2006.01) |

(52) U.S. Cl.

CPC ..... *B24B 7/12* (2013.01); *B24B 9/002* (2013.01); *B24B 27/033* (2013.01); *B24B 41/002* (2013.01); *B24B 47/10* (2013.01); *B24B 47/12* (2013.01)

(58) Field of Classification Search

CPC ..... B24B 7/12; B24B 41/002; B24B 47/10; B24B 9/002

USPC ..... 451/157, 119

See application file for complete search history.

(56) References Cited

U.S. PATENT DOCUMENTS

| | | | | |
|---|---|---|---|---|
| 101,167 | A * | 3/1870 | Keniston | A43D 95/20 12/77 |
| 1,849,868 | A * | 3/1932 | Einstein | B24B 41/04 451/121 |
| 3,435,566 | A | 4/1969 | Enserink | |
| 3,661,018 | A | 5/1972 | Keefer et al. | |
| 3,943,666 | A * | 3/1976 | Dion | B24B 7/00 451/146 |
| 4,397,055 | A | 8/1983 | Cuchiara | |
| 4,537,264 | A | 8/1985 | Schmid et al. | |

(Continued)

FOREIGN PATENT DOCUMENTS

| | | |
|---|---|---|
| DE | 1 502 538 A1 | 4/1969 |
| DE | 296 18 516 U1 | 2/1997 |
| DE | 10 2007 048 544 A1 | 4/2009 |

*Primary Examiner* — George Nguyen

(74) *Attorney, Agent, or Firm* — Bose McKinney & Evans LLP

(57) ABSTRACT

A device for grinding and deburring a flat workpiece comprise a grinding roller having an abrasive coating. A coaxial drive shaft that is connected rotation-fast to the guide roller is driven by a drive motor via a primary belt drive. The grinding roller is borne axially displaceable on the drive shaft. Via a second secondary belt drive, the drive motor drives a cam mechanism, comprising a control cylinder that is rotatably borne on the drive shaft of the grinding roller and that has a groove cam and comprising a cam slide arranged on the grinding roller. The rotating grinding roller thus performs an oscillating axial back-and-forth movement.

10 Claims, 2 Drawing Sheets

(56) References Cited

U.S. PATENT DOCUMENTS

| | | | | |
|---|---|---|---|---|
| 5,402,604 | A * | 4/1995 | Hashii | B24B 27/02 451/155 |
| 5,664,634 | A | 9/1997 | McCracken | |
| 5,738,570 | A * | 4/1998 | Rosenthal | B21B 28/04 451/119 |
| 6,860,797 | B1 * | 3/2005 | Chuang | B24B 7/28 451/155 |
| 2009/0007802 | A1 | 1/2009 | Taitler | |
| 2009/0093197 | A1 | 4/2009 | Ernst | |
| 2011/0028074 | A1 * | 2/2011 | Masuyama | B24B 27/0076 451/57 |

* cited by examiner

DEVICE FOR GRINDING AND DEBURRING A FLAT WORKPIECE

RELATED APPLICATIONS

This application claims priority to EP 15 165 026.4, filed Apr. 24, 2015, which is hereby incorporated herein by reference in its entirety.

BACKGROUND

The invention relates to a device for grinding and deburring a flat workpiece.

During punching or cutting of steel sheets that may well be several centimeters thick, interfering burrs form on the top side of the sheets. These may be ground off by means of a grinding roller. To this end, the workpiece is caused to pass under the relatively rapidly rotating grinding roller by means of a suitable transport mechanism.

DE 10 2007 048 544 A1 describes a device for grinding a flat workpiece with a grinding roller that is driven by an electromotor via V-belt pulleys and V-belts. The circumferential surface of the grinding roller is covered with abrasive paper or abrasive cloth.

A statically borne grinding roller wears unevenly, because the same locations of the abrasive coating always grind the surface of the workpieces. In German specification 1 502 538 it is therefore suggested that the grinding roller be moved back and forth in the transverse direction in order to effect uniform wear of the grinding roller. A connecting rod drive is mentioned as a possible mechanism for producing the back-and-forth movement of the grinding roller in the transverse direction.

U.S. Pat. No. 3,435,566 A describes a grinding and deburring machine having a grinding roller, the shaft of which is borne laterally displaceable in a bearing. No oscillating back-and-forth movement of the grinding roller is provided.

In electric toothbrushes, an electric motor causes a comparatively small brush to move simultaneously in a rotational movement and in an oscillating movement in the axial direction. In the toothbrush in accordance with U.S. Pat. No. 3,661,018 A, the drive shaft of the electric motor is coupled to a cam mechanism that causes the rotational movement of the motor in an axial up-and-down movement. However, in this case, the relationship between the rotational speed of the brush and the oscillation frequency is specified to be fixed. It is not possible to perform less than one oscillation movement per rotation of the motor or brush.

U.S. Pat. No. 4,397,055 describes an electric toothbrush having a small motor that is coupled to a cam mechanism such that the motor both causes the brush, which is embodied like a roller, to rotate and also causes it to oscillate axially. An oscillation frequency below the rotational speed of the motor is not possible in this case, either.

US 2009/007802 A1 describes a kitchen appliance in which the motor simultaneously produces a rotational movement and an oscillation movement for an exchangeable kitchen tool. The oscillation movement is produced by a cam mechanism.

In a large and heavy machine for grinding and deburring, a second drive can be provided that is independent of the primary drive, for the back-and-forth movement of the grinding roller in the axial direction. This has the advantage that the rotary speed of the grinding roller and the frequency of the axial back-and-forth movement may be selected completely independent of one another, or even adjusted during operation. However, providing a second, separate drive for oscillating the grinding roller makes the machine significantly more complicated and, therefore, not just more expensive, but also less reliable in operation.

SUMMARY

This disclosure teaches a device for grinding and deburring a flat workpiece having a grinding roller that, in addition to the rotational movement, also performs an axial back-and-forth movement, without needing a second motor.

In the inventive device, the grinding roller is seated coaxially on the drive shaft, wherein the grinding roller is connected rotation-fast (also referred to herein as "rotation locked" or "non-rotatably connected") to the drive shaft. At the same time, the grinding roller is borne axially displaceable on the drive shaft so that it can perform a back-and-forth movement relative to the location-fast drive shaft. That is, the grinding roller is axially but not rotatably displaceable relative to the drive shaft. The drive motor drives the grinding roller directly and at the same time is coupled to a cam mechanism that produces the oscillating movement of the grinding roller in the axial direction. In this way, a single drive motor is sufficient for producing both the rotational movement of the grinding roller and also its axial back-and-forth movement.

The cam mechanism inventively arranged between the drive motor and the drive shaft of the grinding roller includes a control cylinder that is rotatably borne on the drive shaft of the grinding roller and that has a groove cam and includes a cam slide that is arranged on the grinding roller and that travels the groove cam of the control cylinder. The lateral excursion of the groove cam determines the axial displacement of the grinding roller on the drive shaft.

In the inventive device, the drive motor drives the drive shaft of the grinding roller via a first belt drive and drives the control cylinder of the cam mechanism via a second belt drive. Two belt drives coupled to the drive motor permit the different transmissions to be selected for the first and second drive belts. In this manner, the frequency of the oscillating back-and-forth movement of the grinding roller on the drive shaft may be adjusted independent of the rotational speed of the grinding roller about its axis.

The groove cam may have e.g. a sinusoidal shape. The cam slide preferably travels through one complete sinusoid per rotation of the control cylinder, so that after a complete rotation by the control cylinder, the grinding roller has performed exactly one axial back-and-forth movement in the axial direction. Naturally, it is also possible for the groove cam to have a plurality of minimums and maximums, so that the oscillation frequency is a multiple of the rotational speed of the control cylinder.

In one embodiment of the inventive device, the grinding roller has on its end face a cylindrical recess in which the control cylinder is arranged coaxially. In this manner the cam mechanism may be integrated into the grinding roller without additional space being required.

The grinding roller is especially embodied as a hollow cylinder, at least one axial guide slit being arranged in its interior wall. The drive shaft bears at least one corresponding cam roller that engages in the guide slit of the hollow cylinder. It is furthermore advantageous that at least one plain bearing is arranged between the drive shaft and the grinding roller. It is useful to provide at least two guide slits and corresponding cam rollers that are arranged in the area of the right and left ends of the grinding roller. Cam rollers and axial guide slits form the necessary rotation-fast connection between drive shaft and grinding roller and simultaneously permit the axial displaceability of the grinding roller on the drive shaft in order to permit the oscillating back-and-forth movement of the grinding roller.

The second belt drive, which drives the cam mechanism, is preferably coupled via a connecting shaft to the first drive belt drive, which drives the drive shaft of the grinding roller. Thus the first belt drive represents the primary drive for the grinding roller and the second belt drive, coupled via the connecting shaft, represents a secondary drive for the back-and-forth movement. However, it is also possible to provide two independent belt drives that respectively directly transmit the rotational movement of the drive motor to the grinding roller and the cam mechanism, respectively.

The first belt drive usefully includes a first belt pulley that is seated on the drive shaft of the grinding roller, and the second belt drive includes a second belt pulley that is connected to the control cylinder. A dual belt drive designed in this manner permits, in a simple manner, the drive shaft of the grinding roller and the control cylinder rotatably borne on the drive shaft to rotate at different rotational speeds, in that the two belt drives have different transmission ratios. It is even simple to change the transmission ratios later. For instance, when the rotational speeds of the drive motor and grinding roller are unchanged, the frequency of the oscillating axial movement of the grinding roller may be adapted to altered conditions, e.g. simply by exchanging the belt pulley connected to the control cylinder.

Bearing the grinding roller shaft in the machine frame such that the one end, e.g. the right end, of the drive shaft is borne in a removable roller bearing offers the advantage that the cylindrical grinding roller may be pulled off of the grinding roller in the axial direction of the drive shaft or abrasive coating, which makes the exchange very simple. In this case, it is useful to arrange the two belt drives for the grinding roller and the control cylinder adjacent to one another on the end of the drive shaft opposing the removable bearing. The belt drives, as well, then do not create any obstacle for exchanging the abrasive coating or for exchanging the complete grinding roller by pulling it off in the axial direction of the belt drives.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

Figure 1:
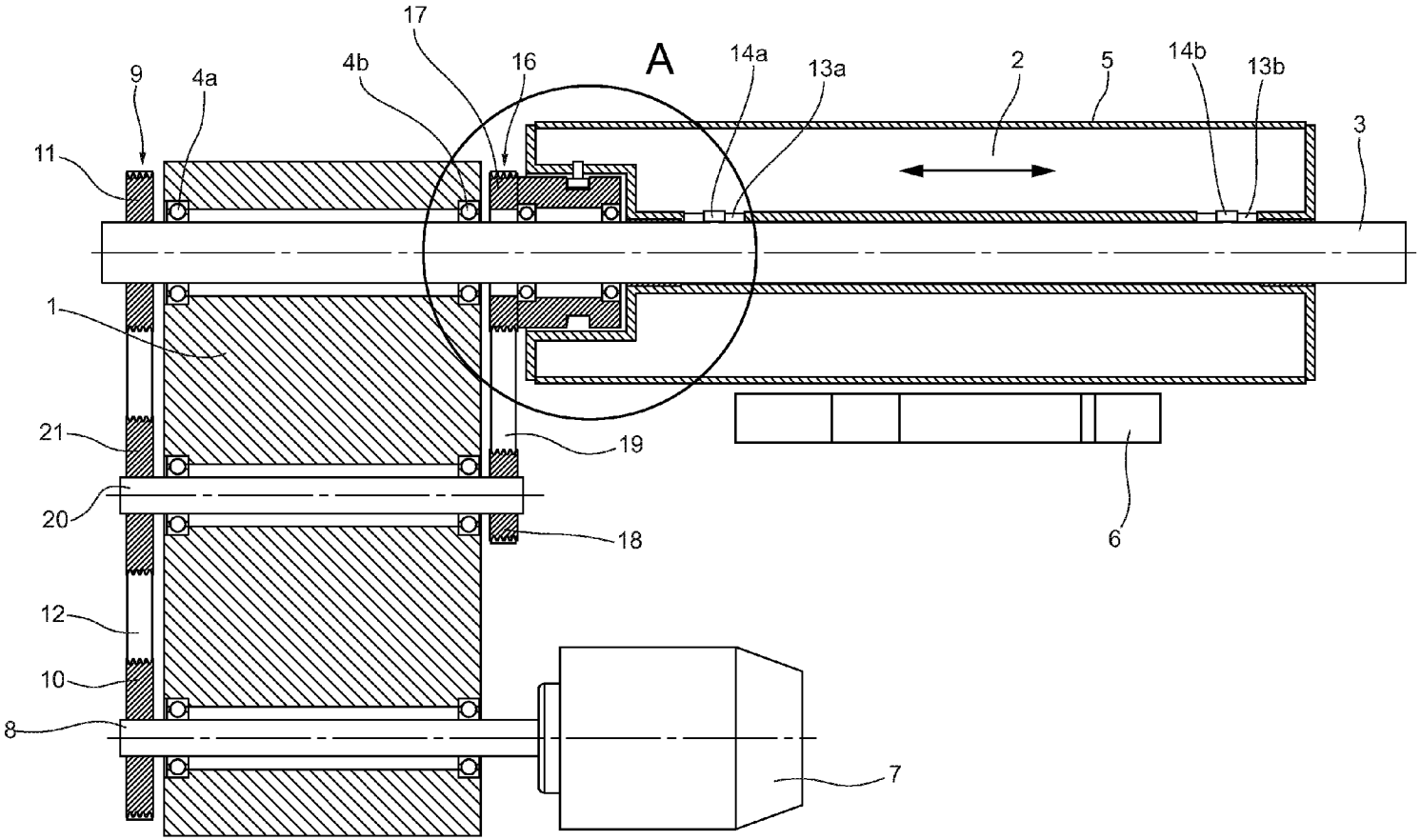
FIG. 1 depicts a highly simplified vertical section of a deburring machine.

Only the essential parts of the deburring machine are shown in the figures if these parts are necessary for understanding this disclosure.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

A grinding roller 2 is rotatably borne about its horizontal axis in a machine stand 1. The grinding roller 2 is seated coaxially on a drive shaft 3 that is rotatably borne using two roller bearings 4*a*, 4*b* in the machine stand 1. The two roller bearings 4*a*, 4*b* are arranged a slight distance from one another. A third roller bearing (not shown) is disposed at the free end of the drive shaft 3 (to the right in FIG. 1), wherein this third roller bearing can be detached from the drive shaft 3 by swinging it away so that the grinding roller 2 is temporarily borne in a floating manner, as shown here.

An abrasive coating 5 for abrading a flat workpiece 6 is arranged on the cylindrical exterior of the grinding roller 2. The abrasive coating 5 in this case is embodied as an infinite cylindrical tube and may be placed axially onto the grinding roller 2 from the end of the drive shaft 3 and removed in the reverse manner. For removing burrs on the essentially flat top side of the workpiece 6, the latter is moved horizontally under the rotating grinding roller 2.

The grinding roller 2 is driven by a drive motor 7, a strong electric motor. Its motor shaft 8 is also borne horizontally in the machine stand 1. The drive motor 7 drives the drive shaft of the grinding roller 2 via a first primary belt drive 9. The belt drive 9 includes a lower belt pulley 10, an upper belt pulley 11 that is seated on the drive shaft 3 of the grinding roller 2, and a drive belt 12 guided via the belt pulleys 10, 11.

The drive shaft 3 is connected rotation-fast (rotation locked) to the grinding roller 2. At the same time, the grinding roller 2 is borne axially displaceable on the drive shaft 3. This is realized using two axial guide slits 13*a*, 13*b* on the cylindrical interior of the grinding roller 2, which is embodied as a hollow cylinder, and two corresponding cam rollers 14*a*, 14*b*, that are seated on the drive shaft 3 and engage in the guide slits 13*a*, 13*b*. A plain bearing 15 (FIG. 2) is arranged between drive shaft 3 and grinding roller 2, so that the grinding roller 2 can easily glide back and forth axially on the drive shaft 3 as far as the relative movement of the cam rollers 14*a*, 14*b* in the guide slits 13*a*, 13*b* permits. The cam rollers 14*a*, 14*b* function as carriers that transfer the rotational movement of the drive shaft 3 to the grinding roller 2.

Not only does the drive motor 7 permit the grinding roller 2 to rotate, but it also effects an oscillating back-and-forth movement of the grinding roller 2 relative to the drive shaft 3. To this end, a second secondary belt drive 16 is provided. This belt drive 16 includes an upper belt pulley 17 and a lower belt pulley 18 via which a drive belt 19 runs. A connecting shaft 20 is rotatably borne horizontally and thus parallel to the drive shaft 3 and to the motor shaft 8 in the machine stand 1. The lower belt pulley 18 is seated on the one end of the connecting shaft 20 (in the figure, this is the right end). Another belt pulley 21 is seated on the opposing end of the connecting shaft 20, approximately in the center between the lower belt pulley 10 and the upper belt pulley 11 of the primary belt drive 9, wherein these three belt pulleys 10, 11, 21 lie in one plane. The drive belt 12 of the primary belt drive 9 is guided via the center belt pulley 21 and thus transmits the rotational movement of the drive motor 7 to the connecting shaft 20 and the secondary belt drive 16 coupled thereto.

At its end face opposing its free end (in FIG. 1 this is the left end), the grinding roller 2 has a large cylindrical recess. A control cylinder 23, also cylindrical, is seated nearly completely in the recess 22 and is borne by means of roller bearings 24*a*, 24*b* on the drive shaft 3 of the grinding roller 2 such that it can rotate freely on the drive shaft 3. A groove cam 25 having an approximately rectangular cross-section is inserted into the lateral surface of the control cylinder 23. As may be seen especially in the enlargement in FIG. 2, a corresponding cam slide 26 is arranged on a cylindrical inner wall of the grinding roller 2 and engages in the groove cam 25 of the control cylinder 23. The cam slide 26 is embodied as a cam roller to reduce the friction between groove cam 25 and cam slide 26.

Figure 2:
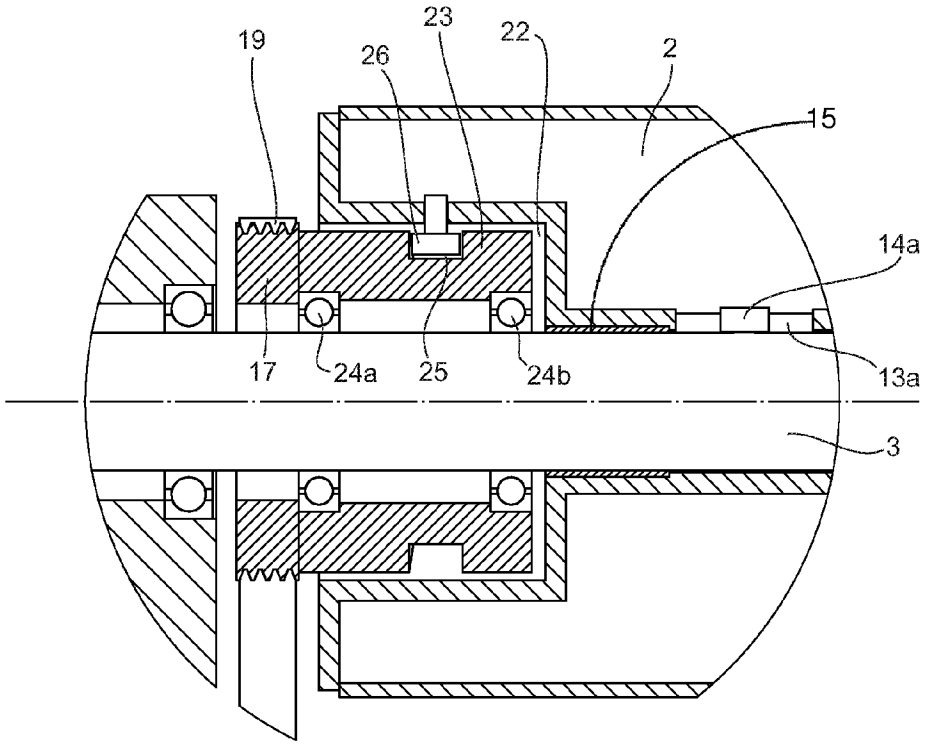
FIG. 2 depicts an enlargement of the area A from FIG. 1.

The upper belt pulley 17 of the secondary belt drive 16 is flange-connected at the free end face of the control cylinder 23 (the left end face in FIGS. 1 and 2). Thus not only does the drive motor 7 drive the grinding roller 2, but it also, via the secondary belt drive 16, causes the control cylinder 23 to rotate coaxially with the grinding roller 2 and its drive shaft 3. The speed at which the control cylinder 23 rotates on the drive shaft 3 is not the same, however, as the speed at which the grinding roller 2 rotates about its axis. Since the two belt drives 9 and 16 have different transmission ratios, the drive shaft 3 and the grinding roller 2 connected rotation-fast thereto and the control cylinder 23 rotate at different speeds.

The groove cam 25 runs in a sinusoidal shape on the lateral surface of the control cylinder 23. Observed over one complete rotation, the groove cam 25 moves back and forth between the right and the left edges of the control cylinder 23, as indicated in FIG. 1 with a double arrow. The cam slide 26 follows this axial oscillating movement axially and thereby transmits the excursion of the groove cam 25 to the grinding roller 2 so that not only does the latter rotate about it axis, but at the same time it performs an oscillating axial back-and-forth movement.

The cam slide 26 travels one period of the sinusoidal groove cam 25 per rotation of the control cylinder 23. The number of back-and-forth movements by the grinding roller 2 depends on the rotational speed of the control cylinder 23 relative to the rotational speed of the grinding roller 2. The grinding roller 2 runs significantly faster than the control cylinder 23. For instance, the speed of the grinding roller is 1,000 rpm (16 per second), while the oscillation frequency is 2/sec. The oscillation frequency is very simple to adjust using the selection of the transmission ratio for the two belt drives 9 and 16 and in particular the ratio of the diameters of the belt pulleys 17, 18 of the secondary belt drive 16.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 Machine stand
2 Grinding roller
3 Drive shaft
4*a*, 4*b* Roller bearing
5 Abrasive coating
6 Workpiece
7 Drive motor
8 Motor shaft
9 Primary belt drive
10 Lower belt pulley (of 9)
11 Upper belt drive (of 9)
12 Drive belt (of 9)
13*a*, 13*b* Guide slits (in 2)
14*a*, 14*b* Cam rollers (on 3)
15 Plain bearing
16 Secondary belt drive
17 Upper belt pulley (of 16)
18 Lower belt pulley (of 16)
19 Drive belt (of 16)
20 Connecting shaft
21 Belt pulley (on 20)
22 Recess (in 2)
23 Control cylinder
24*a*, 24*b* Roller bearing (of 23)
25 Groove cam (in 23)
26 Cam slide (on 2)

What is claimed is:

1. Device for grinding and deburring a flat workpiece, comprising:

a grinding roller having an abrasive coating configured for abrading the workpiece;

a drive shaft that is connected rotation-fast to the grinding roller and on which the grinding roller is axially displaceable;

a drive motor for driving the grinding roller;

a cam mechanism coupled to the drive motor, the cam mechanism producing an oscillating back-and-forth movement of the grinding roller on the drive shaft, the cam mechanism comprising a control cylinder that is rotatably disposed on the drive shaft;

the control cylinder having a groove and the grinding roller having a cam that travels in the groove; and first and second belt drives that are driven by the drive motor, the first belt drive driving the drive shaft and the second belt drive driving the control cylinder.

2. Device in accordance with claim 1, wherein the groove has a sinusoidal shape.

3. Device in accordance with claim 1, wherein an end face of the grinding roller has a cylindrical recess in which the control cylinder is coaxially arranged.

4. Device in accordance with claim 1, wherein the grinding roller comprises hollow cylinder and an axial guide slit is arranged in an interior wall of the hollow cylinder, the drive shaft having a cam roller that engages in the guide slit.

5. Device in accordance with claim 1, further comprising a plain bearing arranged between the drive shaft and the grinding roller.

6. Device in accordance with claim 1, further comprising a connecting shaft that couples the second belt drive to the first belt drive.

7. Device in accordance with claim 1, wherein the first belt drive comprises a belt pulley seated on the drive shaft.

8. Device in accordance with claim 1, wherein the second belt drive comprises a belt pulley connected to the control cylinder.

9. Device in accordance with claim 1, wherein the first and second belt drives have different transmission ratios, whereby the drive shaft and the control cylinder rotate at different speeds.

10. Device in accordance with claim 1, wherein the first and second belt drives are arranged adjacent to one another on one end of the drive shaft.

* * * * *